US006516897B2

(12) United States Patent
Thompson

(10) Patent No.: US 6,516,897 B2
(45) Date of Patent: Feb. 11, 2003

(54) SELF-CONTAINED EXCAVATOR AND ANCHOR APPARATUS AND METHOD

(76) Inventor: Michael C. Thompson, 520 S. Ridge St., Southern Pines, NC (US) 28387

( * ) Notice: Subject to any disclaimer, the term of this patent is extended or adjusted under 35 U.S.C. 154(b) by 11 days.

(21) Appl. No.: 09/790,858

(22) Filed: Feb. 22, 2001

(65) Prior Publication Data

US 2001/0030064 A1 Oct. 18, 2001

Related U.S. Application Data

(60) Provisional application No. 60/184,980, filed on Feb. 25, 2000.

(51) Int. Cl.[7] ..... E21B 07/18
(52) U.S. Cl. ..... 175/19; 175/93
(58) Field of Search ..... 175/19, 21, 22, 175/53, 73, 81, 217, 227, 93

(56) References Cited

U.S. PATENT DOCUMENTS

| | | | | |
|---|---|---|---|---|
| 3,902,563 A | | 9/1975 | Dunn | |
| 4,499,958 A | * | 2/1985 | Radtke et al. | 175/329 |
| 4,618,009 A | * | 10/1986 | Carter et al. | 175/267 |
| 4,793,740 A | | 12/1988 | Schellhorn | |
| 4,871,287 A | * | 10/1989 | Hougen | 408/204 |
| 5,016,717 A | | 5/1991 | Simons et al. | |
| 5,115,873 A | | 5/1992 | Patsusek | |
| 5,178,223 A | | 1/1993 | Smet | |
| 5,305,631 A | | 4/1994 | Whited et al. | |
| 5,339,911 A | | 8/1994 | Whited et al. | |
| 5,361,855 A | | 11/1994 | Schuermann et al. | |
| 5,425,429 A | | 6/1995 | Thompson | |
| 5,454,435 A | | 10/1995 | Reinhardt | |
| 5,456,326 A | * | 10/1995 | Raines | 175/57 |
| 5,622,231 A | | 4/1997 | Thompson | |
| 5,653,298 A | | 8/1997 | Dove et al. | |
| 5,810,519 A | * | 9/1998 | Vogel et al. | 407/114 |
| 5,813,480 A | * | 9/1998 | Zaleski, Jr. et al. | 175/40 |
| 6,050,352 A | | 4/2000 | Thompson | |
| RE37,450 E | * | 11/2001 | Deken et al. | 175/62 |

OTHER PUBLICATIONS

J.E. Akin et al., *Oil and Gas Journal*, "Asymmetric Nozzle Designs Increase Penetration Rate," pp. 42–48 (Jul. 8, 1996).

*Oil and Gas Journal*, "Technology Assists in Testing, Improving Storage Tank Cathodic Protection," pp. 55, 56 (Oct. 21, 1996).

"The Corrosion Engineer's Seeing Eye," Manufacturers Literature from Corrocon, Inc.

"Retrofit Upgrades for In–Service Tanks," Bottom Logic™ Under Tank Systems, Manufacturers Literature from Corrocon, Inc.

Information on PDC bits from manufacturers of Gold Series bits (Smith Tool, Hughes Christensen, Speed Reamer, Diamond Products International) and others, consisting of 25 pages.

* cited by examiner

*Primary Examiner*—Frank S. Tsay
(74) *Attorney, Agent, or Firm*—Merchant & Gould P.C.

(57) ABSTRACT

A self-contained excavation device, with specific application as a beach umbrella excavator and anchor apparatus, includes a cutting head with a stepped cutting edge to penetrate thin shell layers, recesses defining anchor shelves to prevent pullout from wind, and anchor sweep faces for severing a structural connection between the compacted formation material and the recesses for easy removal of the device. The self-contained excavation device also includes a pressure limit chamber to prevent overpressure of the drilling fluid, a floating piston with straight intake ports for easy maintenance, and a self-cleaning valve to prevent debris from accumulating and clogging the valve.

20 Claims, 10 Drawing Sheets

Intake Stroke

Pressure Stroke

Intake Stroke

Pressure Stroke

SELF-CONTAINED EXCAVATOR AND ANCHOR APPARATUS AND METHOD

CROSS REFERENCE TO CO-PENDING PROVISIONAL APPLICATION

This application claims the benefit of U.S. Provisional Patent Application 60/184,980, entitled Beach Umbrella Excavator and Anchor Apparatus, filed Feb. 25, 2000.

FIELD OF THE INVENTION

The present invention relates generally to a self-contained excavation device, and particularly to an improved pressurized fluid excavator and anchor apparatus for a beach umbrella.

BACKGROUND OF THE INVENTION

A self-contained excavation device, with a means for storing and pressurizing the drilling fluid, was disclosed in U.S. Pat. No. 6,050,352 as a beach umbrella anchor. Field testing of the beach umbrella anchor in the above-described patent has suggested additional improvements to that original design.

In general, beach umbrellas must withstand modest wind loads without laterally overturning or vertically pulling out of the formation, which typically comprises beach sand. Overturned beach umbrellas may cause a safety hazard to nearby beach goers. Proper depth of insertion of the umbrella pole into the sand is a critical factor of a successful beach umbrella site. Insertion to a nominal depth of one foot usually provides adequate lateral resistance to wind loads, but vertical pullout is controlled by friction between the pole and the surrounding formation, as well as by the type of sand, the moisture content, and relative compaction of the formation immediately adjacent to the pole. Insertion of the pole into dry sand, where only the bottom end is embedded into wet sand, helps prevent overturning, but not vertical pullout. Also, the diameter of the umbrella pole helps determine both vertical pullout and overturning resistance. During excavation, minor shell layers are occasionally encountered which the blunt-ended bottom of the pole cannot penetrate, thereby preventing easy insertion of the pole to proper depth.

In addition to the above problems relating to anchoring the beach umbrella excavator at a proper depth, additional problems have been identified relating to the pressurized drilling fluid chamber. One such problem relates to the potential of overpressurizing the chamber by excessive use of the air pump. An additional concern relates to the need for frequent maintenance of the fluid release valve. Refilling the apparatus from ocean or lakes can allow debris and sand to accumulate in the lower chamber where drilling fluid is stored, and eventually lodge in the valve, causing leaks and inconsistent valve operation.

It is with regard to this background information that the improvements available from the present invention have evolved.

SUMMARY OF THE INVENTION

One object of the present invention is to provide an improved, self-contained excavation/anchor apparatus which not only uses an internal fluid reservoir to ease the excavating process but also provides an enhanced anchoring ability once the excavation is complete.

Another object of the present invention is to provide an improved, self-contained excavation/anchor apparatus which allows for easy removal of the anchor from the excavated hole.

A further object of the present invention is to provide a self-contained excavation/anchor apparatus with an improved cutting head that dislodge hidden obstructions (such as shells) without requiring the cutting head the cut through such obstructions.

Another object of the present invention is to provide a self-contained excavation/anchor apparatus having an improved pressurization system for an internal supply of drilling fluid which prevents overpressurization of the drilling fluid.

A further object of the present invention is to provide a self-contained excavation/anchor apparatus having an improved delivery system for an internal supply of drilling fluid which prevents debris within the drilling fluid from clogging the delivery system and interfering with the operation of the excavation apparatus.

In one preferred embodiment, the apparatus of the present invention includes a cutting head at one end of an excavation tube where the excavation tube includes at least one recess in its outer surface. The recess forms an anchor shelf for engaging the surrounding formation material. Compaction of the formation material (by the drilling fluid applied during the excavation process) forms a connection between the surrounding formation and the anchor shelf which prevents the cutting head from being easily pulled from the excavated hole. The recesses also define anchor sweep faces adjacent the anchor shelf for sweeping or severing the connection between the anchor shelf and the surrounding formation.

Another embodiment of the present invention includes a stepped cutting head forming a plurality of sweep faces to assist in clearing shell layers and other minor obstructions away from the cutting edge during excavation.

A further embodiment of the present invention includes a self-contained excavation/anchor apparatus having a check valve for limiting the pressure that can be applied to a reservoir of drilling fluid carried within the apparatus. Furthermore, because the drilling fluid may often include debris (such as when the apparatus is refilled from ocean water), a self-cleaning valve is employed to prevent such debris from clogging the fluid delivery system and causing the apparatus to malfunction.

In one preferred embodiment, the apparatus comprises an excavator/anchor for a beach umbrella where an end of the apparatus opposite the cutting head is adapted to receive and hold an upper pole of the beach umbrella. Of course, a variety of other objects may make use of the present invention, such as anchoring torches, signs, etc. within the sand or loose soil. Furthermore, the apparatus of the present invention may be beneficially used wherever one needs to create relatively shallow excavations (e.g., gardening or underground utility probes).

A method of using the excavation/anchor apparatus is also disclosed.

A more complete appreciation of the present invention and its scope can be obtained from understanding the accompanying drawing, which is briefly summarized below, the following detailed description of presently preferred embodiments of the invention, and the appended claims.

DETAILED DESCRIPTION OF THE PREFERRED EMBODIMENTS

Figure 1:
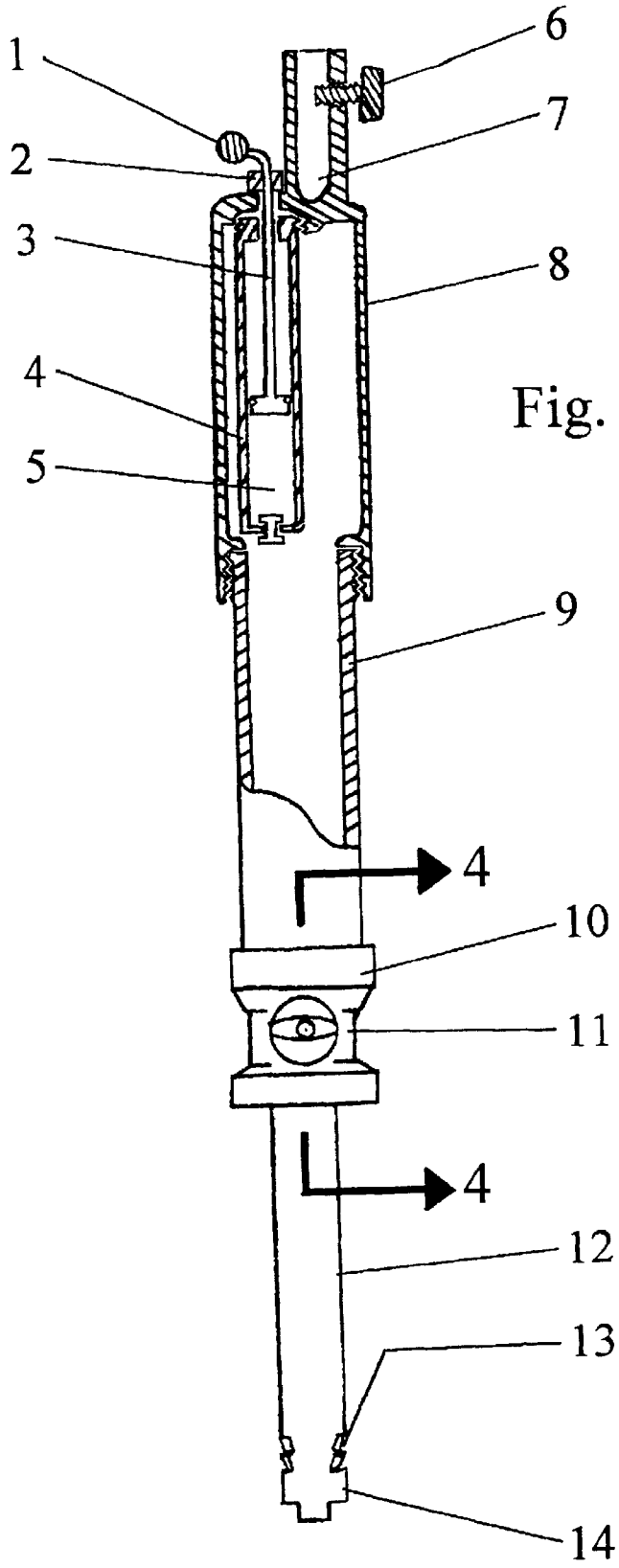
FIG. 1 is a front elevated view of a self-contained excavator and anchor apparatus of the present invention with an upper portion shown in section to illustrate details of an upper and lower chamber and a pump assembly which together define a pressure boundary.

FIG. 1 shows an overall cut away view of a preferred embodiment of the present invention comprising a self-contained excavator and anchor assembly. While the preferred embodiment illustrated in FIG. 1 and describe below is adapted for use with beach umbrellas, it will be evident to those skilled in the art that the present invention may find additional uses beyond the realm of beach umbrellas as described in greater detail below.

The assembly comprises a number of separate components (secured together by threaded connections) including an upper chamber (8), a lower chamber (9), an excavation tube (12) having a cutting head (14) at one end, and a collar (10) that connects the lower chamber (9) to the excavation tube (12). The collar (10) also includes a valve assembly (11) that directs pressurized fluid within the upper and lower chambers (8) and (9) through the excavation tube (12) so that the fluid impinges on either the cutting head (14) or the formation itself (e.g., sand) as pressure is applied to the head (14) to bury the tube (12) in the surrounding formation.

The upper chamber (8) includes an integral adapter (7) for receiving an end of a pole. In the preferred embodiment, the adapter (7) receives the end of a top pole of a beach umbrella where the entire excavation and anchor assembly replaces the conventional bottom pole of the beach umbrella (i.e., the pole which typically includes a pointed end for burying the bottom pole within the sand). A thumbscrew (6) in the adapter (7) may be tightened against the inserted umbrella pole to prevent pull-out or rotation of the pole in relation to the adapter (7). In one preferred embodiment, the adapter (7) and the thumbscrew (6) provide for retention of any beach umbrella pole from 1 inch to 1½ inches in diameter. Furthermore, while the present invention is described in relation to its use with a beach umbrella, those skilled in the art would understand that a variety of other apparatus may be secured within the adapter (7). For example, torches, signs, flags and tent stakes represent only a small sample of the different alternatives to umbrellas that could benefit from the present invention.

As noted above, the present invention represents a self-contained excavation apparatus which includes the ability to pressurize a drilling fluid contained within the upper and lower chambers (8) and (9). The upper chamber (8) thus includes a pump assembly (4) used to pressurize the drilling fluid. The pump assembly (4) comprises a cylindrical pressure limit chamber (5) secured within the upper chamber (8) such as by an interior threaded connection. A pump handle (1) and stop (2) are located on one end of a shaft (3) that protrudes from the chamber (5). Details of the internal pressure limit chamber (5) are described below in conjunction with FIGS. 2 and 3.

The upper chamber (8) is threaded at the lower end to receive the lower chamber (9) as shown in FIG. 1. The connection between the upper chamber (8) and the lower chamber (9) preferably defines the top of the drilling fluid maximum refill level when the apparatus is held in a vertical position. The large, full diameter opening in the top of the lower chamber (9) allows easy refill from available sources near the excavation location such as lakes, rivers or the ocean (i.e., when the drilling fluid is water). The collar (10) houses the valve assembly (11) as shown in detail in FIG. 4. The collar (10) is solvent welded, or otherwise structurally attached, to the lower chamber (9) to form a pressure seal. When assembled, the interior cavity surrounded by the air pump assembly (4), the upper chamber (8), the lower chamber (9), the collar (10), and the valve assembly (11) form a pressure boundary. This pressure boundary will be subjected to nearly the same maximum pressure as that generated within the air pump assembly (4) under normal operation.

Figure 6:
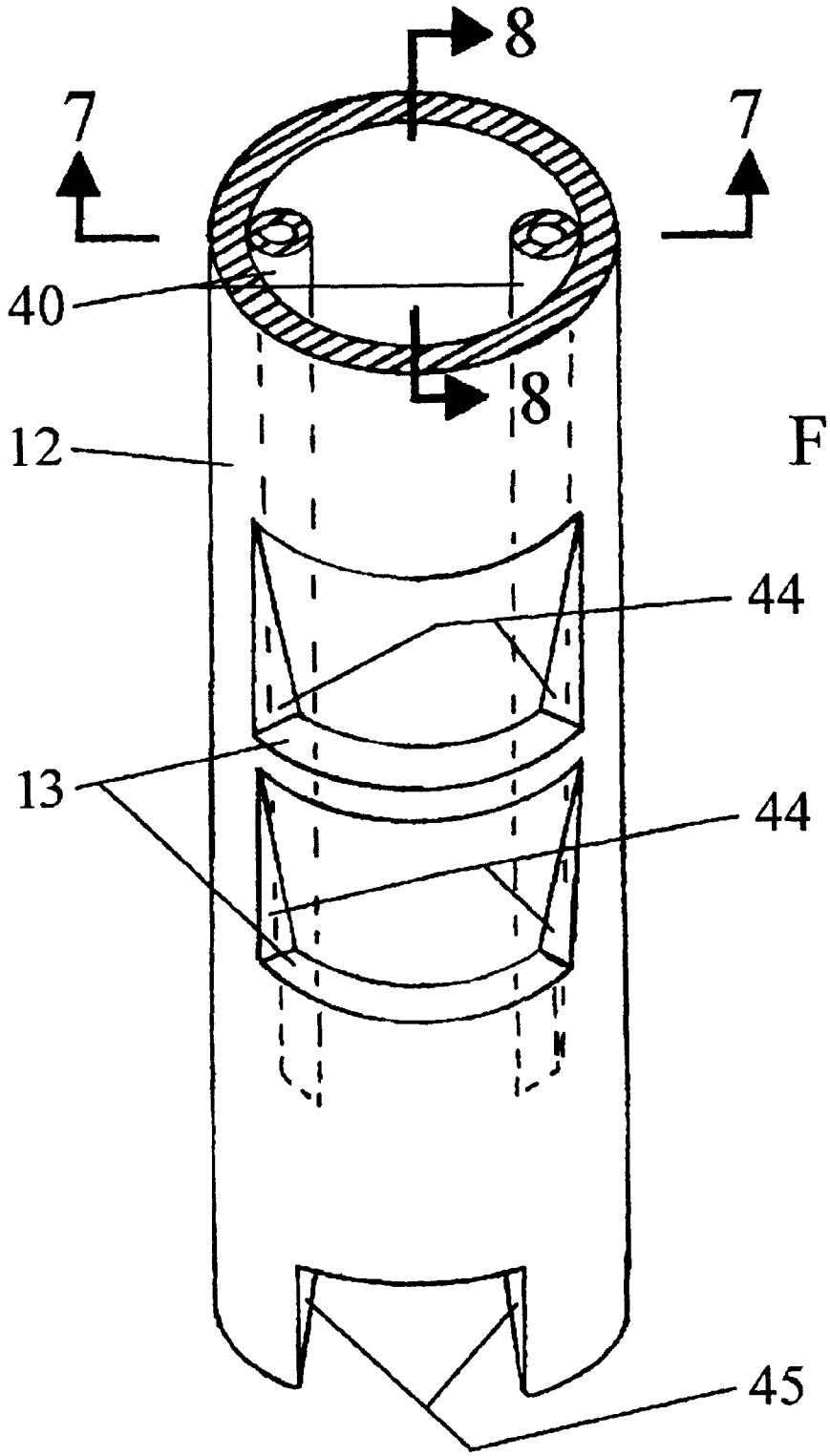
FIG. 6 is an enlarged isometric view of a lower portion of an excavator tube and cutting head illustrating anchor shelves and sweep faces formed in the lower portion of the excavator tube.

The excavation tube (12) is the portion of the apparatus that is buried during excavation, and once inserted acts structurally both as a cantilever beam to resist lateral wind loads and in tension to prevent vertical pull out. The lower end of the excavation tube (12) defines the anchor shelves (13) and the cutting head (14), which are shown in detail in FIGS. 6, 7 and 8. FIG. 6 shows an isometric side view of the excavation tube (12) which reveals the preferred configuration of the anchor shelf (13) indentations in the tube (12). While the preferred embodiment of the excavation tube (12) is cylindrical (i.e., having a circular cross section similar to the cross section of most beach umbrellas poles), the tube (12) may be formed with a different cross sectional shape for use in different applications. For example, a rectangular cross section would be preferred where the tube (12) is used as the base of a "water shovel" used to dig in compacted sand.

Figure 7:
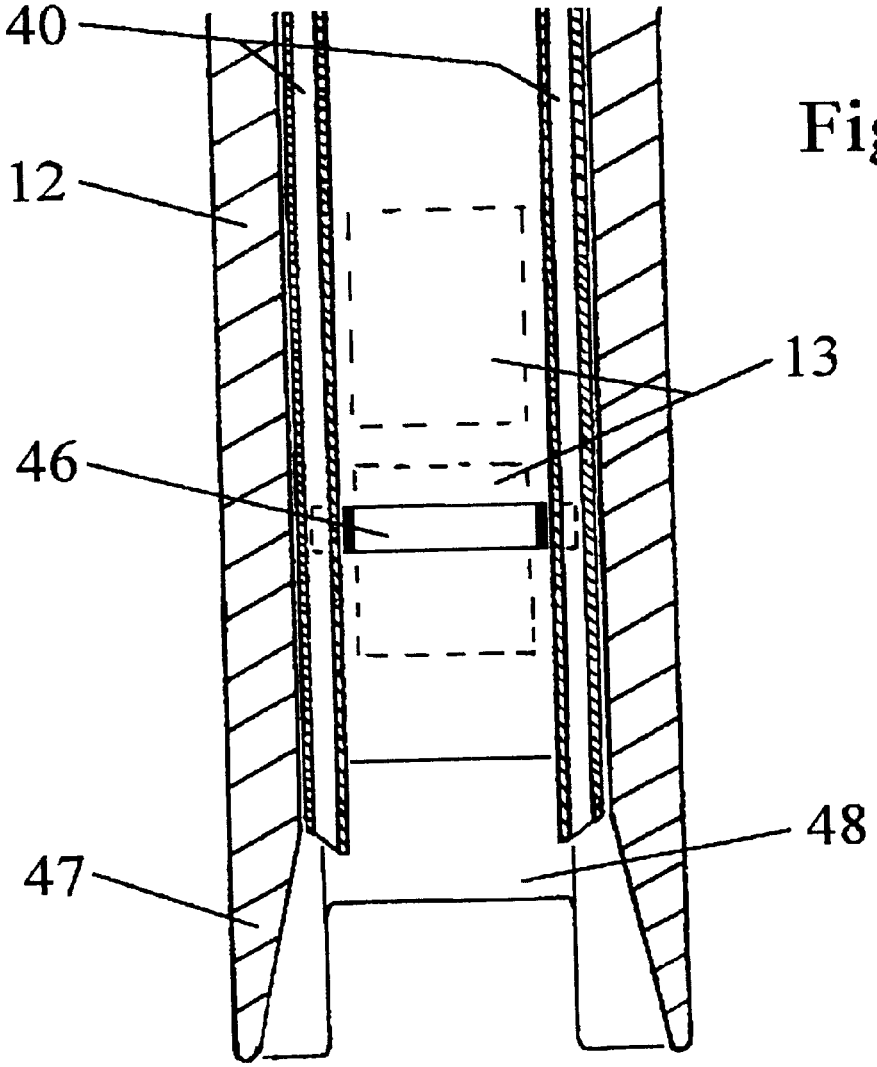
FIG. 7 is a section view taken substantially along the line 7—7 in FIG. 6 illustrating the position and orientation of drilling fluid supply lines within the excavator tube.

FIG. 7 shows the cutting head (14) along Section 7—7 in FIG. 6 and illustrates how the drilling fluid can be directed to impinge directly on the interior of the cutting head (14). This type of direct impingement technique can increase the rate of penetration during excavation, as well as dissipate the concentrated water stream emerging from the cutting head (14).

Figure 2:
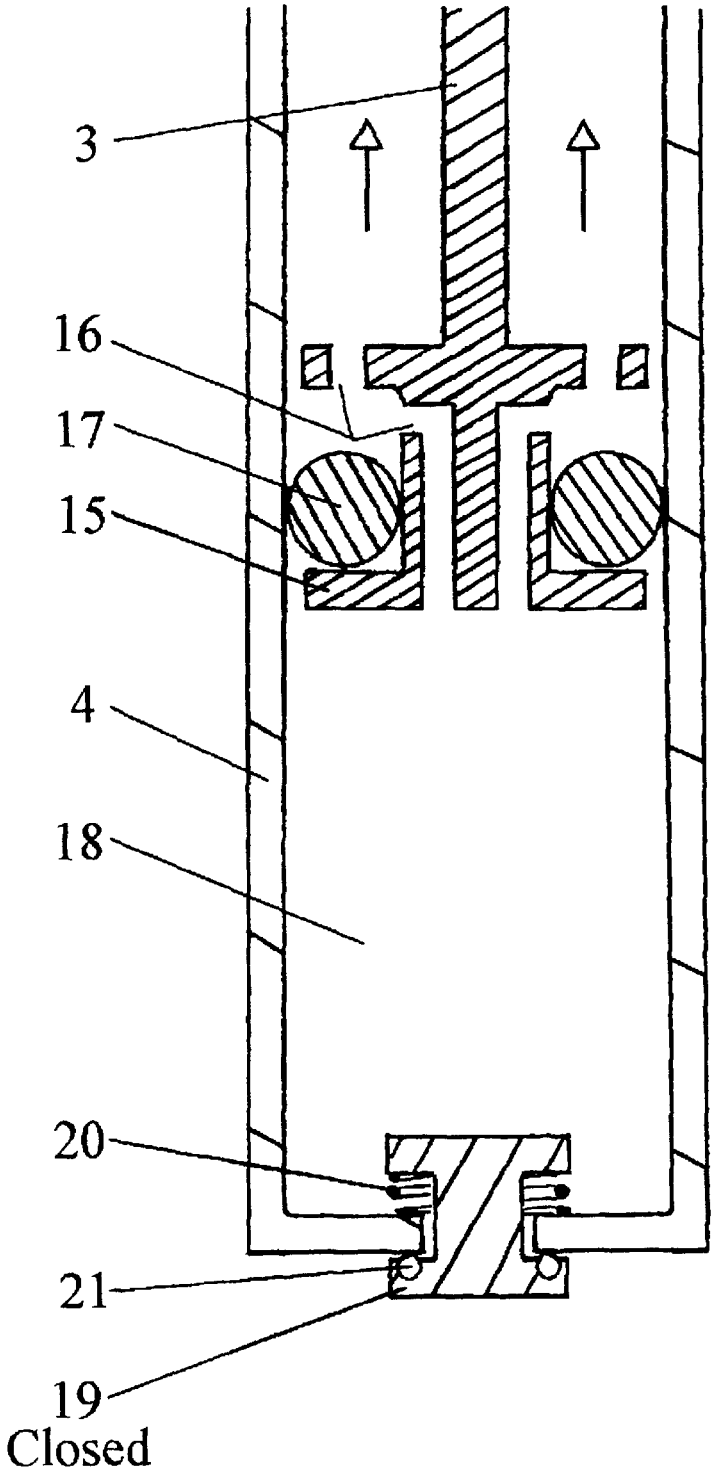
FIG. 2 is an enlarged section view of a pressure limit chamber of the pump assembly shown in FIG. 1 illustrating an intake stroke of a piston.
Figure 3:
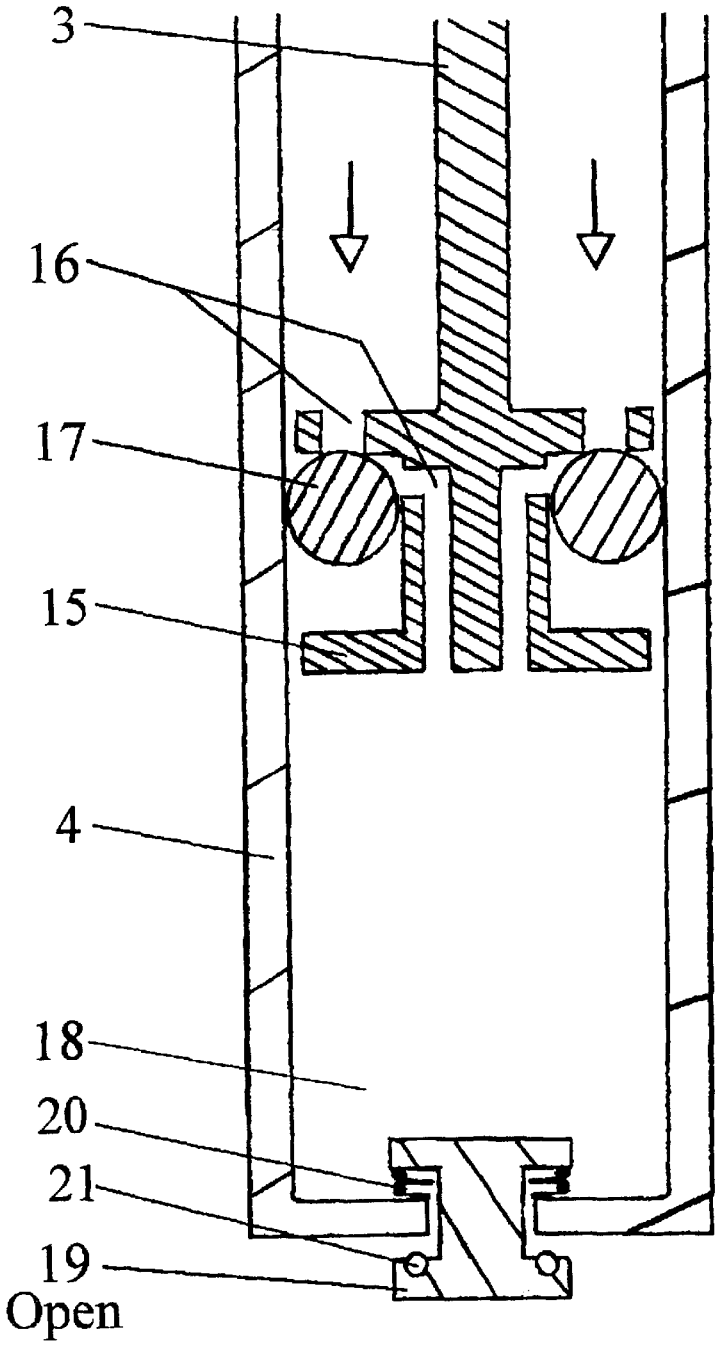
FIG. 3 is an enlarged section view of a pressure limit chamber of the pump assembly shown in FIG. 1 illustrating a pressure stroke of the piston.

Returning to the details of the pump assembly (4) in FIGS. 2 and 3, an intake stroke is shown in FIG. 2 where the upward travel of a piston (15) opens intake ports (16) that were previously blocked by floating O-ring (17). Specifically, FIG. 2 illustrates the point of contact between the piston (15) and the floating O-ring (17). As the piston

(15) continues upward, a partial vacuum is created in a pressure limit chamber (18), allowing higher pressure atmospheric air, or fluid if immersed, to flow into the chamber (18) of the pump assembly (4). Once the chamber (18) is filled, the handle (1) is depressed to initiate the pressure stroke shown in FIG. 3.

With respect to FIG. 3, the floating O-ring (17) and piston (15) are shown in their furthest downward travel during the pressure stroke. The downward travel of the piston (15) is limited by the stop (2) shown in FIG. 1. Location of the stop (2) along the shaft (3) controls the maximum pressure generated in a pressure limit chamber (18). The further downward the piston (15) travels, the higher the pressure obtained in the pressure limit chamber (18).

A check valve (19) at the bottom of the pressure limit chamber (18) is shown in an open position during the pressure stroke illustrated in FIG. 3, and in a closed position during the intake stroke shown in FIG. 2. A seal (21) prevents back flow from the pressure boundary to the pressure limit chamber (18) when the check valve (19) is closed, as shown in FIG. 2. Thus, the check valve (19) allows pressure to build up in the pressure boundary during a continuous cycle of "intake" and "pressure" strokes until a maximum pressure is reached. The maximum pressure obtained in the pressure boundary will always be slightly less than that achieved in the pressure limit chamber (18) since a spring (20) provides a bias force to the check valve (19) that must first be overcome before air within the chamber (18) can pass into the pressure boundary.

In operation, compression of the handle (1) forces air, or fluid, into the pressure boundary, and is repeated until operating pressure is reached (typically several reciprocating strokes are required to reach operating pressure). Note that, during the intake (upward) stroke of the piston (15) shown in FIG. 2, the overpressure in the pressure limit chamber (18) is allowed to vent to the atmosphere. This feature ensures that the pump handle (1) will not rise following the final pressure stroke due to the residual overpressure in the pressure limit chamber (18).

Those skilled in the art will understand that other prior art pistons with integral check valves can be used to operate the pressure limit chamber (18). Indeed, an alternative embodiment of the piston (15) is described in detail below in conjunction with FIGS. 9 and 10. Additionally, those skilled in the art will understand that alternative means for pressurizing the drilling fluid may be employed within the excavator/anchor apparatus of the present invention. For example, the entire pump assembly (4) could be replaced with a valve allowing a user to connect the pressure boundary to a source of pressurized air (such as an air compressor or a bicycle pump). Alternatively, the pressure boundary could be formed from a unified chamber that includes a valve allowing the chamber to be filled from a source of pressurized fluid. See, for example, U.S. Pat. No. 6,050,352 which describes a fluid reservoir having a refill valve (see FIG. 2) in place of the above-described pump assembly (4). U.S. Pat. No. 6,050,352 is owned by the inventor of the present application and its disclosure is hereby incorporated by reference.

While the preferred method for refilling the pressure boundary with drilling fluid it to unscrew the upper chamber (8) from the lower chamber (9) and fill the lower chamber with water as described above, an alternate refilling method can also be used. This alternate method has the advantage of not requiring a user to unscrew the upper and lower chambers. Rather, a user need only immerse the unit in water so that fluid is allowed to fill the pump assembly (4) at the intake adjacent the shaft (3). The user need only operate the pump handle (1) to draw fluid into the pump assembly (4) and hence into the pressure boundary, pressurizing the trapped air. Refilling the apparatus in this manner allows the user to overcome the above-described pressure limit since the pressure limit chamber (18) will only operate with a compressible fluid, such as air (i.e., an incompressible fluid such as water does not have a pressure limit). Continued operation of the immersed pump assembly (4) thus allows pressurization of the pressure boundary beyond the above-described maximum pressure obtained with a compressible fluid in the pressure limit chamber (18).

Different water levels within the pressure boundary can be used for the various types of excavations performed by the apparatus of the present invention. For example, a relatively larger volume of water reduces the volume of the air pocket above the water level and provides a longer and slower rate of water flow during operation. Such increased water volume is useful for operation of the cutting head through hidden shell layers or other minor obstructions. Operation of the excavator device within the tide line on a sand beach requires a relatively smaller volume of water since the sand is already wet. Field testing of the present invention has produced a hole a 14 inches deep in damp beach sand in less than two seconds, while operation in dry sand has produced 12 inch excavation depths in slightly less than three seconds. When the sand includes shell layers, formation of the hole typically requires rotation of the cutting head during release of the fluid to cut through the shell layers. In some cases, a refill of the drilling fluid and a second operation of the valve assembly (11) is necessary to obtain a 12 inch excavation depth.

Figure 4:
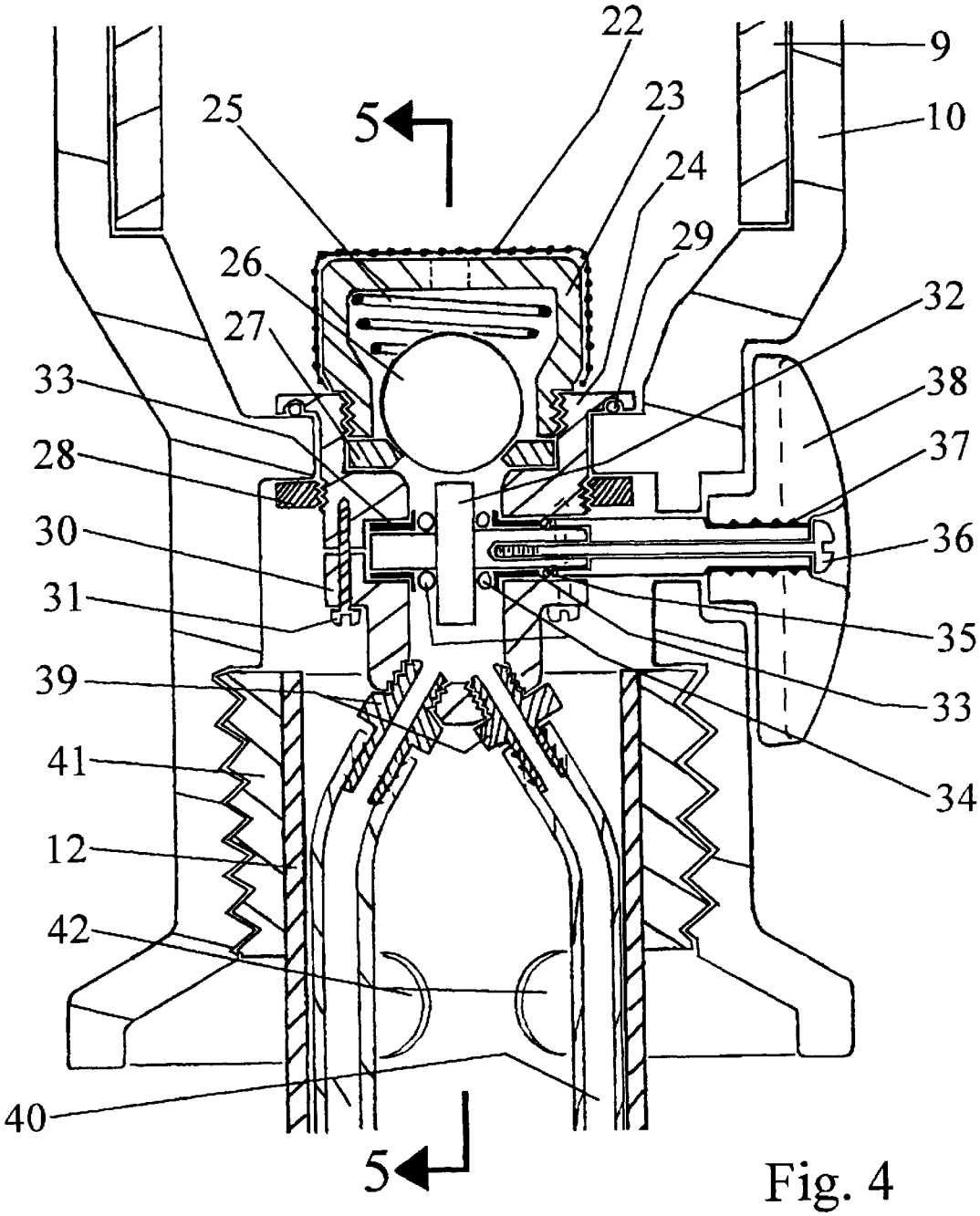
FIG. 4 is an enlarged section view taken substantially along the line 4—4 in FIG. 1 illustrating a self-cleaning cam valve in a closed position.

FIG. 4 illustrates a section view of the self cleaning cam valve assembly (11) which includes improvements designed to overcome the debris and sand clogging found to occur in conventional ball valves. Normally, this debris enters when the excavation device is refilled, especially in the ocean where sand, seaweed, small shells and fragments are ingested in the lower chamber (9).

As a first defense against such debris, the valve assembly (11) of the present invention includes a screen (22) protecting the valve intake. FIG. 4 illustrates that the screen (22) is held in place by a cage (23) which includes a lower threaded end that is secured to an upper valve housing (24) for easy removal and cleaning. The upper valve housing (24), in turn, is held in place by a threaded nut (28) attached to the lower end of the collar (10).

The valve assembly (11) further includes a spring (25) which applies a constant force on a ball (26). In the absence of any opposing force from an actuator or cam (32), the spring force ensures that the ball (26) forms a proper seal with a seat (27). An O-ring (29) recessed within the upper valve housing (24) contacts an upper surface of the collar (10) thereby sealing the pressure boundary between the collar (10) and the upper valve housing (24). The O-ring (29) is easily serviced when the valve assembly (11) is removed. A lower valve housing (30) is attached to the upper valve housing (24) by threaded screws (31). The plane of separation between the two housings is located along the horizontal centerline of a shaft portion of cam (32) to allow the entire valve assembly (11) to be torn down for maintenance and service.

Two bushings (33) align the cam (32) directly underneath the ball (26), provide a structural bearing area for rotation, and limit end movement of the shaft portion of the cam (32).

Two inner O-rings (34) form a seal to limit the pressure boundary from leaking into the bushings during operation of the valve. The bushings (33) are seated against the upper and lower valve housings (24) and (30) during assembly to form a pressure seal between the bushings (33) and the valve housings. An outer O-ring (35) seals the bushing (33) from contamination by sand or saltwater or other foreign material, such as when the apparatus is immersed in water for cleaning. A threaded retaining screw (36) retains the deformed shaft end (37) and valve handle (38), in addition to providing a compressive force to help seal the outer O-ring (35). The screw (36) thus allows the valve handle (38) and the cam (32) to turn as a single unit to lift the ball (26) off the seat (27) against the force of the spring (25).

The lower valve housing (30) includes threaded openings for two nipples (39) attached to supply tubes (40) for directing pressurized drilling fluid (e.g., water) toward the cutting head (14). A threaded bushing (41) fixed to the top of the excavation tube (12) allows a threaded connection to the collar (10) which, in turn, allows for easy removal of the excavation tube (12) for service. Vent holes (42) formed in the excavation tube (12) at the widened portion of the collar (10) direct expended drilling fluid and tailings slurry along the outside of the excavation tube (12). This expelled fluid flows onto the excavation site at the base of the excavation tube (12) to help saturate the formation and aid in compaction as the fluid drains away from the excavated hole. Such compaction locks the sand, or adjacent formation, around the exterior of the excavation tube (12) providing structural contact between the apparatus and the formation. It is significant that other mechanical boring devices that excavate holes for umbrella poles cannot achieve the same compaction unless fluids are also poured around the excavation site after excavation is complete.

Figure 5:
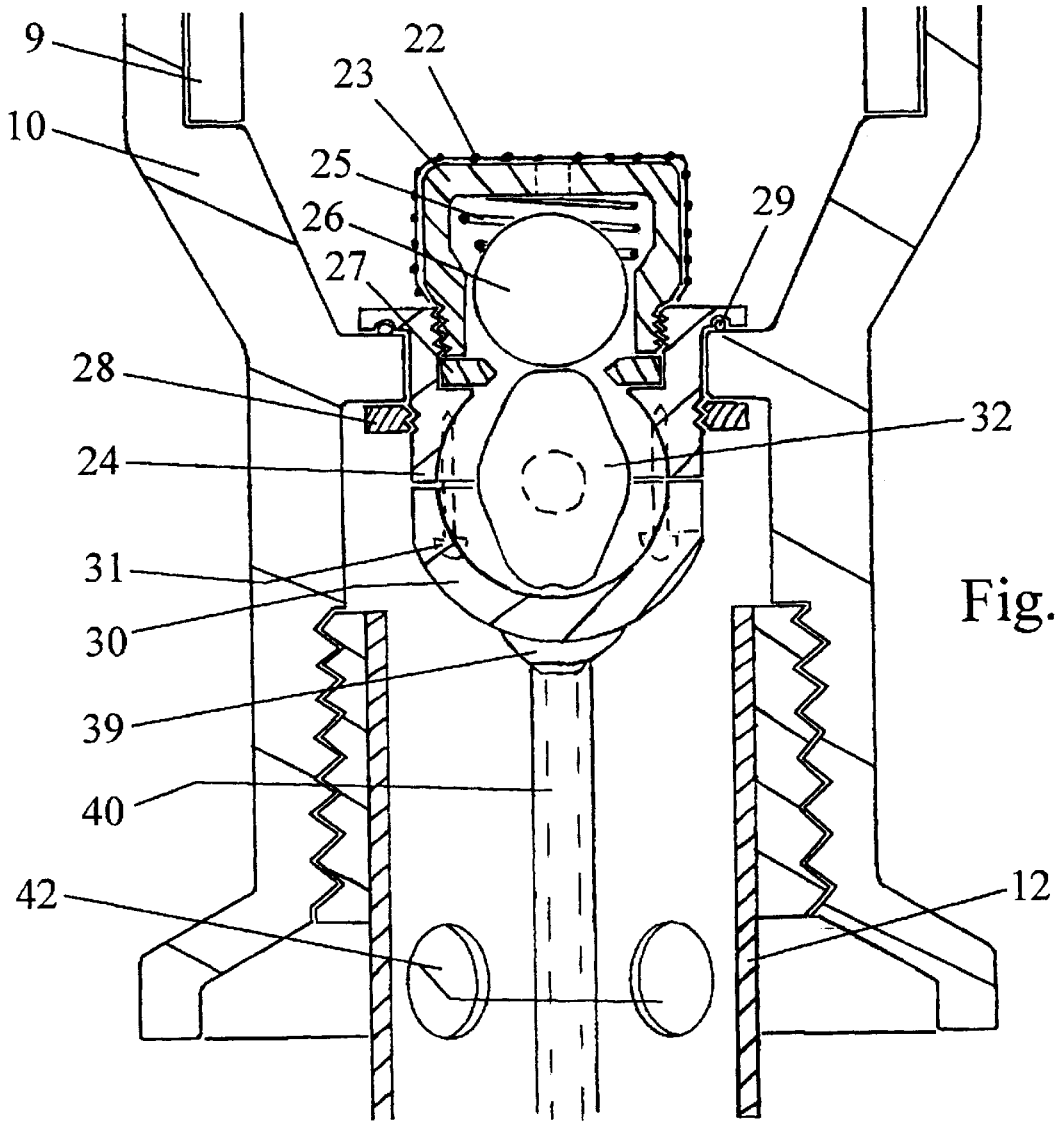
FIG. 5 is an enlarged section view taken substantially along the line 5—5 in FIG. 4 illustrating the self-cleaning cam valve in an open position.

Operation of the valve assembly (11) is more clearly shown in FIG. 5 which illustrates another section of the assembly where the cam (32) is shown from an end position rather than the side view shown in FIG. 4. FIG. 5 further differs from FIG. 4 by illustrating the valve being activated to allow fluid within the pressure boundary to flow past the ball (26) and through the supply tubes (40). This activated position is achieved by rotating the handle (38) and the attached cam (32) so that the cam surface engages the ball (26) and raises the ball upward off the seat (27) against the force of the spring (25). Cross section lines have been omitted from the ball (26) and the cam (32) for clarity in both FIGS. 4 and 5.

FIG. 5 illustrates the cam (32) being rotated 90 degrees relative to its position in FIG. 4. Note that upon rotating the cam 90 degrees from its closed position, a slight indent exists on the top surface of the lobes of the cam (32) to allow the ball (26) to settle into this indent at a "fully open" position. The force of the spring (25) holds the ball (26) in this indent to aid the operator in maintaining the valve in the "fully open" position. Further rotation of the valve handle (38) causes the cam (32) to rotate back to a closed position (FIG. 4) where the ball (26) again returns to the seat (27) under the force of the spring (25) to halt the fluid flow through the supply lines (40).

The design of the valve assembly 11 helps prevent debris from clogging the fluid pathway as often occurs in prior art valves. This is particularly important for excavators used for beach umbrellas where refilling the excavator may entail using water from an ocean or lake that contains a relatively large quantity of debris. With prior art valves, debris may become lodged between the valve seals, often O-rings, and the valve body or ball of a conventional ball valve, often requiring disassembly to clean the valve. When left unchecked, such debris can compromise the pressure boundary, causing leakage of the drilling fluid.

The disclosed cam valve of the present invention is less susceptible to clogging since it allows easy seating and cleaning of the seat (27) during operation. The fluid flow over the seat (27) prevents any foreign matter from accumulating on the sealing face of the seat (27). In those events where large debris particles do penetrate the screen (22), the presently disclosed valve assembly (11) provides for relatively easy cleaning by flushing the seat (27) with water when the cam (32) and ball (26) are in the "fully open" position.

The ability to maintain a tight seal between the ball (26) and the seat (27) is important since the apparatus of the present invention will often be filled with a drilling fluid (e.g., water) at a remote site before being transported to the excavation site. That is, the pressure boundary must be able to hold a static pressure to allow sufficient time to transport the apparatus to an excavation site (e.g., a beach) without allowing the water to escape prematurely through the valve. On the other hand, the integrity of the seal downstream of the seat (27) is less significant than the seal upstream of the seat (27) since the total time required to excavate a hole using the present invention is typically less than five seconds. Therefore, small amounts of leakage (e.g., past the bushings (33)) during operation of the valve assembly (11) are acceptable provided that the vast majority of the drilling fluid is applied to the drilling site.

With the excavator in the vertical position, the air pocket that forms above the top of the drilling fluid is the last to pass through the passageway in the valve assembly (11). As this turbulent air passes through the supply tubes (40) it pressurizes the inside of the excavation tube (12), forcing any remaining drilling fluid and excavation tailings through the vent holes (42). This vented fluid slurry is deflected by the lower portion of the collar (10) and directed down the outside of the excavation tube (12) to aid in saturating the formation that directly contacts the excavation tube (12). The force of the turbulent air is sufficient to displace nearly all the drilling slurry from the inside of the excavation tube (12), thus aiding the operator in cleaning the device once it is removed from the excavated hole.

FIG. 6 is a partial isometric view of the bottom of the excavation tube (12) below the collar (10) and the valve assembly (11). It illustrates a number of improvements over prior art anchors including the anchor shelf (13), the anchor sweep faces (44) and the shell sweep faces (45) of the cutting head (14).

The anchor shelves (13) prevent vertical pull out from tensile forces on the umbrella pole and excavator device usually caused by wind. The anchor shelves (13) are formed at the bottom of a recessed area within the excavation tube (12) which is filled with a saturated slurry of the excavated formation as the excavation tube (12) is inserted into the formation. Once fluids stop flowing from the apparatus, fluid drains away into the surrounding formation, highly compacting the formation around the excavation tube (12) and into the recessed area of the anchor shelves (13). When an upward vertical load is applied, the anchor shelf (13) directly resists this force through increased shear with the surrounding formation.

To prevent difficulty in removing the apparatus from the formed hold, anchor sweep faces (44) are provided so that lateral movement or axial rotation of the apparatus acts to "sweep" or sever the structural connection between the compacted sand, or slurry, and the recessed area above the anchor shelves (13). In the preferred embodiment illustrated in the Drawing, a rotational sweeping action with the vertical faces (44) results in a clean circular hole from which the excavation tube (12) is easily removed. However, when the cross sectional shape of the excavation tube (12) is not circular (as described above), a lateral motion rather than axial rotation may be applied to the sweep faces (44) to sever the connection between the compacted formation and the anchor shelves (13).

Figure 8:
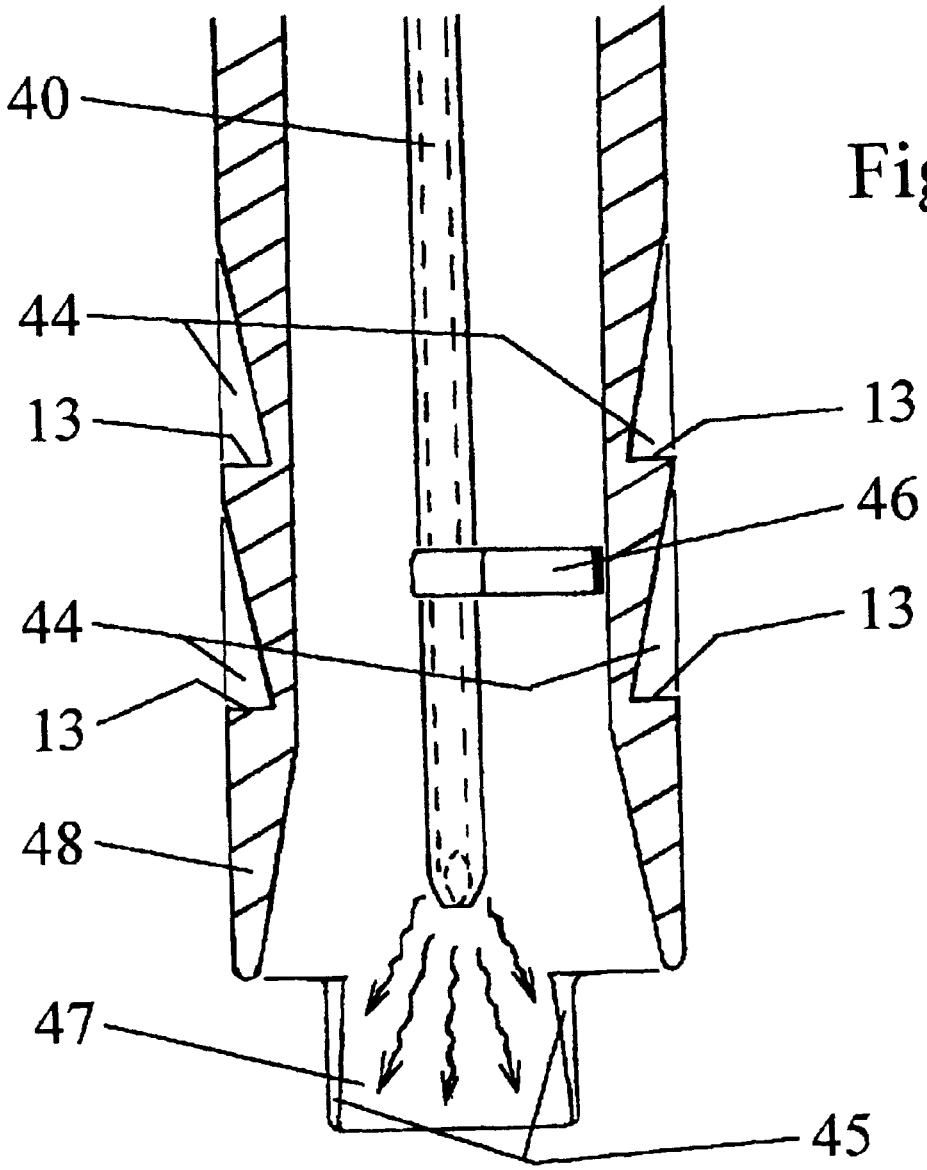
FIG. 8 is a section view taken substantially along the line 8—8 in FIG. 6.

The shell sweep faces (45) work in a similar manner, but are used to penetrate shell layers and other minor obstructions, usually hidden below grade, during excavation. The shell sweep faces (45) are formed at the sides of openings or gaps in a stepped cutting edge of an upper cutter (48), as shown in FIGS. 7 and 8. During excavation, the drilling fluids provide a washing effect on the obstruction, while the rotating shell sweep faces (45) dislodges the larger fragments so that they become part of the drilling slurry. By transporting the larger fragments away from the cutting head (14) with the slurry, the shell sweep faces (45) increase the rate of penetration of the cutting head (14). While some stubborn or thick layers may require more than one fluid filling and discharge of the apparatus to complete excavation, the present invention still provides for easier excavation of a 12–14 inch hole than prior art mechanical devices (e.g., sharpened points) that do not have the advantage of decreasing the structural resistance of the formation by fluid saturation.

FIG. 7 displays a section view of the lower portion of the excavator tube (12) shown in FIG. 6. A retainer (46) holds the supply tubes (40) in place by compressing the tubes against the interior wall of the excavation tube (12). The retainer (46) is preferably made from a stainless spring steel, or other suitable material that does not corrode from hostile environments, including saltwater and beach sand.

The supply tubes (40) are angle cut at the end to direct the fluid flow on the interior face of the lower cutter (47). Alternatively, the tubes (40) could be adjusted to direct the flow of drilling fluid at the formation rather than the cutter face. The sharp end of the angle cut is shown nipped off for safety. The lower cutter (47) has a sloped interior wall to direct the drilling slurry toward the center of the excavation tube (12) and forces the slurry upward during excavation. The upper cutter (48) is stepped higher along the excavation tube (12) to form the shell sweep faces (45).

The cutting edge has a small radius to prevent injury from misuse, particularly with regard to children. For applications (other than the preferred beach umbrella excavator and anchor) where safety is not a paramount concern, a sharp edge is preferred to provide for a faster rate of penetration. Furthermore, textures such as a saw tooth may be added to the edge for cutting through roots and other obstructions.

FIG. 8 illustrates another section view similar to FIG. 7 where the excavation tube (12) and cutting head (14) have been rotated 90 degrees from the section shown in FIG. 7. The fluid stream emerging from the angle cut end of the supply tube (40) dissipates across the interior face of the lower cutter (47) and is preferably adjusted to impinge on the entire cutting face at the cutting edge. As the lower cutter (47) penetrates the formation, the immediate area near the lower cutter (47) becomes saturated beyond structural integrity, and becomes a slurry that is easily penetrated by the upper cutter (48) when an adequate weight-on-bit force is applied. In applications where the formation does not easily saturate, additional supply tubes (40) can be installed to direct the drilling fluid at both the upper cutter (48) and the lower cutter (47).

FIG. 8 further illustrates that the anchor sweep faces (44) are aligned with the exterior of the excavation tube (12) to form a circular hole when rotated about the vertical axis. This circular hole enhances removal of the apparatus from the formation as described above.

Figure 9:
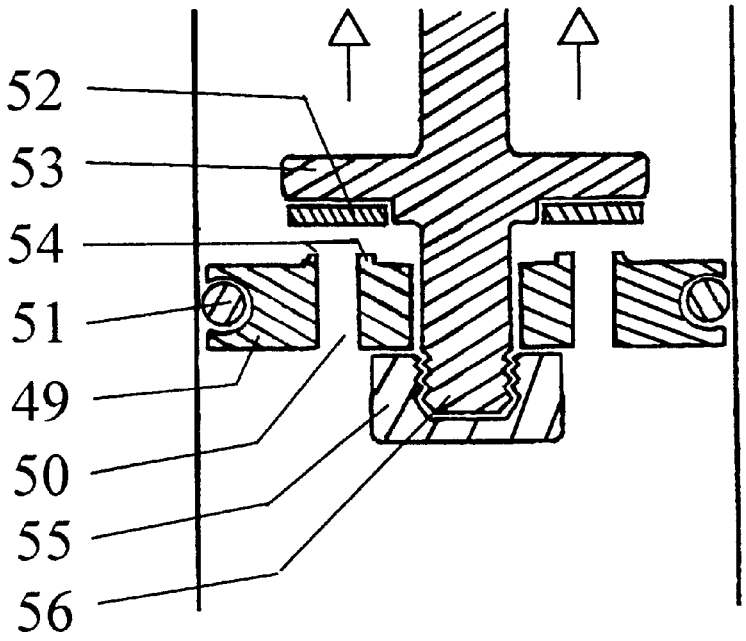
FIG. 9 is an enlarged section view similar to FIG. 2 showing an alternative embodiment of the piston shown in FIG. 2 during an intake stroke.
Figure 10:
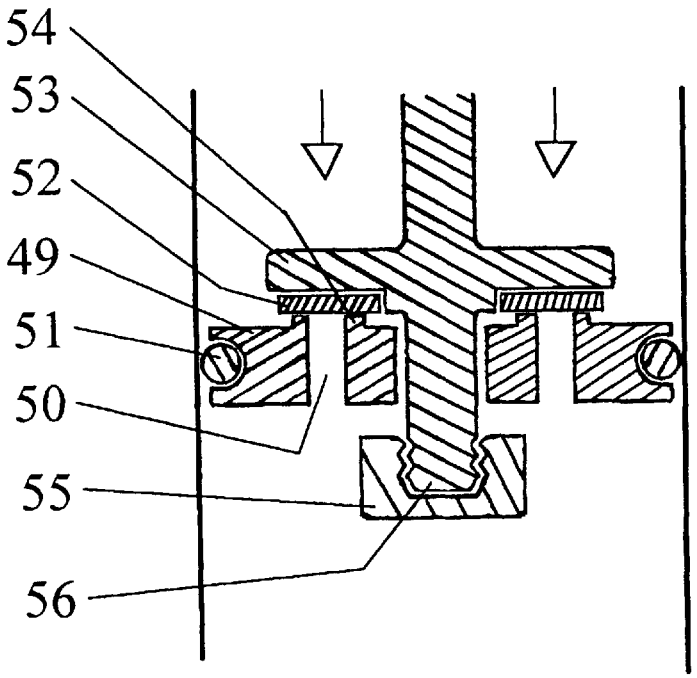
FIG. 10 is an enlarged section view similar to FIG. 3 showing an alternative embodiment of the piston shown in FIG. 3 during a pressure stroke.

FIGS. 9 and 10 illustrate the intake and pressure strokes, respectively, of a floating piston (49) which represents an alternative embodiment of the piston (15) shown in. FIGS. 2 and 3. The piston (49) represents an improvement over the piston (15) when the apparatus is used as a beach umbrella excavator since the piston (49) is less prone to clogging from foreign material and is thus easier to maintain. Straight intake ports (50) have no bends in the passageway to impede and accumulate debris, and are easy to clean using a straight wire or similar object. In addition, the delicate O-ring (51) is not disturbed or damaged during cleaning.

The circular flat washer (52), supported by the shaft lug (53), provides a seal when compressed against the raised seat (54). Two raised seats (54) are shown in FIGS. 9 and 10, however any number of seats may penetrate the piston as needed. The flat washer (52) is easy to replace by unthreading the end nut (55) from the threaded shaft (56) and sliding the floating piston (49) off the end. Once the flat washer (52) is replaced, the floating piston (49) can be reassembled and installed in the pump assembly (4).

The pressure stroke (FIG. 10) displays the extreme downward travel of the floating piston (49) and threaded shaft (56), while the intake stroke (FIG. 9) displays the maximum gap between the flat washer (52) and the raised seat (54) as the end nut (55) raises the floating piston (49). An explanation of the pumping operation starts from the fully downward position of the floating piston (49), as shown in FIG. 10.

An initial pressure (e.g., normal atmospheric pressure) exists in the pressure boundary and the pump assembly (4) at the start of the pumping operation. As the handle (1) is raised, the threaded shaft (56) is retracted until the end nut (55) engages the floating piston (49), as illustrated on the intake stroke in FIG. 9. This movement opens the straight intake ports (50) so that the pressure limit chamber (18) is in fluid connection with the surrounding environment (e.g., atmospheric pressure). Initially, any existing overpressure of the pressure limit chamber (18) is vented to the surrounding environment.

As the handle (1) is raised to the top limit of the stroke, surrounding fluid or air is forced into the partial vacuum created in the pressure limit chamber (18). The handle (1) is then depressed, sliding the threaded shaft (56) downward until the flat washer (52) seals against the raised seat (54), thereby isolating the interior of the pressure limit chamber (18) from the surrounding environmental pressure. Continued downward motion of the handle (1) pressurizes the pressure limit chamber (18) as well as the pressure boundary across the check valve (19) in the same manner described above with respect to FIGS. 2 and 3.

When the desired pressure in the pressure boundary is obtained, operation is stopped. Once the operator releases the handle (1), the overpressure in the pressure limit chamber (18) forces the flat washer (52) to unseal itself from the raised seat (54), thereby releasing the overpressure to the surrounding environment. The force of gravity will then typically pull the handle (1) back down to the position shown in FIG. 10. If frictional forces hinder the above-described release of the overpressure to the surrounding environment following the final stroke, a spring may be added between the floating piston (49) and the shaft lug (53) to insure separation of the flat washer (52) and the raised seat (54) for proper operation.

As described above, the present invention provides a number of benefits over prior art excavator/anchors, including the prior beach umbrella excavator/anchor described in U.S. Pat. No. 6,050,352. The improvements include the use of anchors shelves (13) for retaining the formation, as well as anchor sweep faces (44) for easy removal of the anchor from the hole. Shell sweep faces (45) provide for an improved cutting action, particularly on beaches where hidden shell layers are likely to be encountered beneath the sand. Additionally, the improved pump assembly (4) and valve (11) described above prevent malfunctions and leaks caused by debris within the drilling fluid.

While the preferred embodiment of the present invention is described for use with beach umbrellas, it is understood that those skilled in the art could apply the excavation/anchor apparatus and method of the present invention to a myriad of different uses. As noted above, the anchor could be used on the beach with items such as torches, signs, tent or cabana poles, or any other similar object that one would desire to stake to the beach. The excavation method and apparatus could also be used in gardening, utility line probes, post hole diggers, etc., where one needs to form a relatively shallow hole.

Presently preferred embodiments of the present invention have been described with a degree of particularity. These descriptions have been made by way of preferred example and are based on a present understanding of knowledge available regarding the invention. It should be understood, however, that the scope of the present invention is defined by the following claims, and not necessarily by the detailed description of the preferred embodiments.

What is claimed:

1. A self-contained excavation apparatus for forming a hole within a surrounding formation, said apparatus comprising:

a cutting head;

a compartment for storing drilling fluid;

means for pressurizing the drilling fluid;

means for directing the pressurized drilling fluid toward the surrounding formation during penetration of the cutting head into the formation; and means for securing the cutting head within the hole formed in the surrounding formation to hinder vertical pull out of the cutting head from the hole.

2. A self-contained excavation apparatus as defined in claim 1 wherein:

the cutting head is located at an end of a vertical excavation tube; and the means for securing the cutting head within the hole includes a recessed area formed within an outer surface of the excavation tube, the recessed area defining a horizontal anchor shelf adapted to engage surrounding formation material following compaction of the formation material within the recessed area.

3. A self-contained excavation apparatus as defined in claim 2, further comprising:

vertical sweep faces formed within the recessed area at opposite ends of the horizontal anchor shelf, the vertical sweep faces adapted to sweep the compacted formation material and sever the engagement between the horizontal anchor shelf and the compacted formation material upon lateral movement of the excavation tube.

4. A self-contained excavation apparatus as defined in claim 3 wherein the vertical excavation tube is adapted to support a beach umbrella.

5. A self-contained excavation apparatus for forming a hole within a surrounding formation, said apparatus comprising:

a cutting head formed at one end of an excavation tube, the cutting head including a stepped cutting edge defining vertical sweep faces for clearing obstructions in the formation as the excavation tube is rotated about a vertical axis;

a compartment for storing drilling fluid;

means for pressurizing the drilling fluid; and means for directing the pressurized drilling fluid toward the surrounding formation during penetration of the cutting head into the formation.

6. A self-contained excavation apparatus as defined in claim 5, further comprising:

means for securing the excavation tube within the hole formed in the surrounding formation to hinder vertical pull out of the excavation tube from the hole.

7. A self-contained excavation apparatus as defined in claim 6 wherein the excavation tube is adapted to support a beach umbrella.

8. A self-contained excavation apparatus for forming a hole within a surrounding formation, said apparatus comprising:

a cutting head;

an internal compartment for storing drilling fluid;

means for pressurizing the drilling fluid;

means for limiting a maximum pressure that can be applied to the drilling fluid; and means for directing the pressurized drilling fluid toward the surrounding formation during penetration of the cutting head into the formation.

9. A self-contained excavation apparatus as defined in claim 8, wherein the means for pressurizing the drilling fluid includes a pressure limit chamber having a check valve separating the pressure limit chamber from the drilling fluid compartment.

10. A self-contained excavation apparatus as defined in claim 9, wherein the pressure limit chamber includes a floating piston having straight intake ports to help prevent debris from clogging the intake ports.

11. A self-contained excavation apparatus as defined in claim 8, wherein the means for directing the pressurized drilling fluid toward the surrounding formation includes a self-cleaning valve.

12. A self-contained excavation apparatus as defined in claim 8 wherein the cutting head is formed at one end of an excavation tube adapted to support a beach umbrella.

13. A method of anchoring a self-contained excavation apparatus in a surrounding formation, comprising the steps of:

storing drilling fluid within a compartment of the self-contained excavation apparatus;

pressurizing the drilling fluid;

applying a drilling force to a cutting head at one end of the self-contained excavation apparatus to penetrate the surrounding formation;

directing the pressurized drilling fluid toward the surrounding formation during penetration of the cutting head into the formation to form a slurry of excavated formation material; and compacting excavated formation material into a recessed area formed in the end of the self-contained excavation apparatus adjacent the cutting head to hinder vertical pull out of the cutting head from the formation.

14. A method as defined in claim 13, wherein the recessed area defines a horizontal anchor shelf adapted to engage the surrounding formation.

15. A method as defined in claim 14, wherein the recessed area further defines vertical sweep faces at opposite ends of the horizontal anchor shelf, said method further comprising the step of:

moving the self-contained excavation apparatus in a lateral direction to sweep the compacted formation material and sever the engagement between the horizontal anchor shelf and the surrounding formation.

16. A method as defined in claim 15, further comprising the step of:

securing a beach umbrella to an end of the self-contained excavation apparatus opposite the cutting head.

17. A method of anchoring a self-contained excavation apparatus in a surrounding formation, comprising the steps of:

storing drilling fluid within a compartment of the self-contained excavation apparatus;

pressurizing the drilling fluid;

applying a drilling force to a cutting head at one end of the self-contained excavation apparatus to penetrate the surrounding formation, the cutting head including a stepped cutting edge defining vertical sweep faces;

directing the pressurized drilling fluid toward the surrounding formation during penetration of the cutting head into the formation to form a slurry of excavated formation material; and rotating the self-contained excavation apparatus about a vertical axis to clear obstructions in the formation with the vertical sweep faces of the cutting head.

18. A method as defined in claim 17, further comprising the step of:

compacting excavated formation material into a recessed area formed in the end of the self-contained excavation apparatus adjacent the cutting head to hinder vertical pull out of the cutting head from the formation.

19. A method as defined in claim 18, further comprising the step of:

securing a beach umbrella to an end of the self-contained excavation apparatus opposite the cutting head.

20. A method of anchoring a self-contained excavation apparatus in a surrounding formation, comprising the steps of:

storing drilling fluid within an internal compartment of the self-contained excavation apparatus;

pressurizing the drilling fluid;

limiting a maximum pressure that can be applied to the drilling fluid;

applying a drilling force to a cutting head at one end of the self-contained excavation apparatus to penetrate the surrounding formation; and directing the pressurized drilling fluid toward the surrounding formation during penetration of the cutting head into the formation to form a slurry of excavated formation material.

* * * * *